US011052982B2

(12) United States Patent
Kray et al.

(10) Patent No.: US 11,052,982 B2
(45) Date of Patent: Jul. 6, 2021

(54) APPARATUS FOR DOVETAIL CHORD RELIEF FOR MARINE PROPELLER

(71) Applicant: General Electric Company, Schenectady, NY (US)

(72) Inventors: Nicholas Joseph Kray, Mason, OH (US); Stefaan Guido Van Nieuwenhove, Bavaria (DE); Peggy Lynn Baehmann, Glenville, NY (US)

(73) Assignee: General Electric Company, Schenectady, NY (US)

( * ) Notice: Subject to any disclaimer, the term of this patent is extended or adjusted under 35 U.S.C. 154(b) by 24 days.

(21) Appl. No.: 15/295,168

(22) Filed: Oct. 17, 2016

(65) Prior Publication Data

US 2018/0105241 A1 Apr. 19, 2018

(51) Int. Cl.
*B63H 1/20* (2006.01)
*B63H 1/26* (2006.01)

(52) U.S. Cl.
CPC ..... *B63H 1/20* (2013.01); *B63H 1/26* (2013.01)

(58) Field of Classification Search
CPC .... F01D 5/3007; F01D 5/3015; F01D 5/3092; F04D 29/322; F04D 29/325; F04D 29/34; F04D 29/324; F04D 29/388; B63H 1/20; B63H 1/2611; B63H 1/26
USPC ..... 410/207, 214 R, 220 R
See application file for complete search history.

(56) References Cited

U.S. PATENT DOCUMENTS 116,414 A 6/1871 Cochrane
512,751 A 1/1894 Schmaltz
787,745 A 4/1905 Freid
1,050,119 A 1/1913 Flanders
2,754,919 A * 7/1956 Blue ..... F04D 29/325 416/238

(Continued)

FOREIGN PATENT DOCUMENTS

CN 203222103 U 10/2013
DE 71360 C 4/1893

(Continued)

OTHER PUBLICATIONS

KR-20160052842-A_MachineTranslation, May 2016 [Retreived on Oct. 2019], (Year: 2016).*

(Continued)

*Primary Examiner* — Christopher Verdier
*Assistant Examiner* — Elton K Wong
(74) *Attorney, Agent, or Firm* — Dority & Manning, P.A.

(57) ABSTRACT

A blade member includes a leading edge, a trailing edge, and a blade body extending therebetween. The blade member also includes a dovetail, a transition region, and a transition relief. The dovetail includes a dovetail chord line extending between an axially forward face of the dovetail and an axially aft face of the dovetail. The dovetail chord line has a dovetail chord length. The transition region is formed between the blade body and the dovetail. The blade body and the transition region form a blade body transition chord line at the interface of the blade body and the transition region which has a blade body transition chord length. The transition relief includes a geometric relief in at least one of a forward and an aft end of the transition region and the dovetail. The dovetail chord length is less than the blade body transition chord length.

13 Claims, 8 Drawing Sheets

(56) References Cited

U.S. PATENT DOCUMENTS

| | | | | |
|---|---|---|---|---|
| 4,466,776 | A | 8/1984 | Camboulives | |
| 4,930,987 | A | 6/1990 | Stahl | |
| 5,018,941 | A | 5/1991 | Heurtel et al. | |
| 5,256,035 | A | 10/1993 | Norris et al. | |
| 5,310,318 | A * | 5/1994 | Lammas | F01D 5/3007 416/219 R |
| 5,375,978 | A * | 12/1994 | Evans | B64C 11/26 416/224 |
| 5,611,665 | A | 3/1997 | Angel | |
| 5,785,498 | A * | 7/1998 | Quinn | F01D 5/14 416/224 |
| 6,312,223 | B1 | 11/2001 | Samuelsson | |
| 6,537,031 | B1 | 3/2003 | Bacskay | |
| 8,235,666 | B2 | 8/2012 | Rosenkranz et al. | |
| 8,608,446 | B2 | 12/2013 | Pickens et al. | |
| 8,851,852 | B2 | 10/2014 | Blatchford | |
| 8,851,855 | B2 * | 10/2014 | James | F01D 5/282 416/224 |
| 9,039,378 | B2 | 5/2015 | Ulgen | |
| 9,051,845 | B2 | 6/2015 | Bommanakatte et al. | |
| 9,068,465 | B2 | 6/2015 | Keny et al. | |
| 2014/0079553 | A1 | 3/2014 | Ulgen | |
| 2014/0271178 | A1 * | 9/2014 | Lattanzio | F01D 5/3007 416/1 |
| 2015/0056080 | A1 * | 2/2015 | Hogberg | F01D 5/3015 416/204 R |
| 2016/0186581 | A1 * | 6/2016 | Dierksmeier | F01D 5/323 416/219 R |

FOREIGN PATENT DOCUMENTS

| | | | | |
|---|---|---|---|---|
| KR | 2016052842 | A * | 10/2014 | B63H 1/20 |
| KR | 10-2015-0080852 | A | 7/2015 | |
| KR | 20160052842 | A * | 5/2016 | |

OTHER PUBLICATIONS

International Search Report and Written Opinion issued in connection with corresponding PCT Application No. PCT/US2017/51088 dated Nov. 21, 2017.

* cited by examiner

APPARATUS FOR DOVETAIL CHORD RELIEF FOR MARINE PROPELLER

BACKGROUND

The field of the disclosure relates generally to propulsion systems and, more particularly, to a method and system for a marine propeller formed of a composite material.

Some highly cambered marine propellers include a thin propeller body coupled to a thick dovetail. The propeller body has a highly cambered shape to promote propulsion through the water. A transition region transitions the shape of the thin propeller body into the thick dovetail. The dovetail is coupled to a hub and attaches the propeller body to the hub. Rotational forces are transferred from the hub to the propeller body through the dovetail and the transition region. Three dimensional peak stresses occur in the transition region as the marine propeller rotates through the water. These three dimensional peak stresses, typically located at the leading and trailing edges of the transition region are amplified when the blade dovetail is either skewed relative to the engine centerline or curved.

BRIEF DESCRIPTION

In one aspect, a blade member is provided. The blade member includes a leading edge, a trailing edge, and a blade body extending therebetween. The blade member also includes a blade root including a dovetail, a transition region, and a transition relief. The blade root is formed at a radially inner base of the blade body. The dovetail is formed at a radially inner side of the blade root and includes a dovetail chord line extending between an axially forward face of the dovetail and an axially aft face of the dovetail. The dovetail chord line has a dovetail chord length. The transition region is formed between the blade body and the dovetail and includes a transition region chord line having a transition region chord length. The blade body and the transition region form a blade body transition chord line at the interface of the blade body and the transition region which has a blade body transition chord length. The transition relief includes a geometric relief in at least one of a forward end and an aft end of at least one of the transition region and the dovetail. The dovetail chord length is less than the blade body transition chord length.

In another aspect, a blade member for a marine propeller is provided. The blade member includes a leading edge, a trailing edge, and a blade body extending therebetween. The blade member also includes a dovetail, a transition region, and a transition relief. The dovetail is formed at a radially inner base of the blade body. The transition region is formed between the blade body and the dovetail. The transition region causes a peak stress in the blade member greater than a predetermined threshold. The transition relief includes a geometric relief in at least one of a forward end and an aft end of at least one of the transition region and the dovetail. The transition relief is sized such that the peak stress is reduced to less than the predetermined threshold.

In yet another aspect, a propeller assembly is provided. The propeller assembly includes a central hub, a plurality of blade wedges, and a plurality of blades. The central hub includes a leading end, a trailing end, and a hub body extending therebetween. The central hub also includes a plurality of channels spaced circumferentially around the central hub and extending between the forward end and the aft end. The plurality of blade wedges and dovetails are configured to be inserted into the plurality of channels. Each blade of the plurality of blades includes a blade root including a dovetail, a transition region, and a transition relief. The blade root is formed at a radially inner base of the blade body. The dovetail is formed at a radially inner side of the blade root and includes a dovetail chord line extending between an axially forward face of the dovetail and an axially aft face of the dovetail. The dovetail chord line has a dovetail chord length. The transition region is formed between the blade body and the dovetail and includes a transition region chord line having a transition region chord length. The blade body and the transition region form a blade body transition chord line at the interface of the blade body and the transition region which has a blade body transition chord length. The transition relief includes a geometric relief in at least one of a forward end and an aft end of at least one of the transition region and the dovetail. The dovetail chord length is less than the blade body transition chord length.

DRAWINGS

These and other features, aspects, and advantages of the present disclosure will become better understood when the following detailed description is read with reference to the accompanying drawings in which like characters represent like parts throughout the drawings, wherein.

Figure 1:
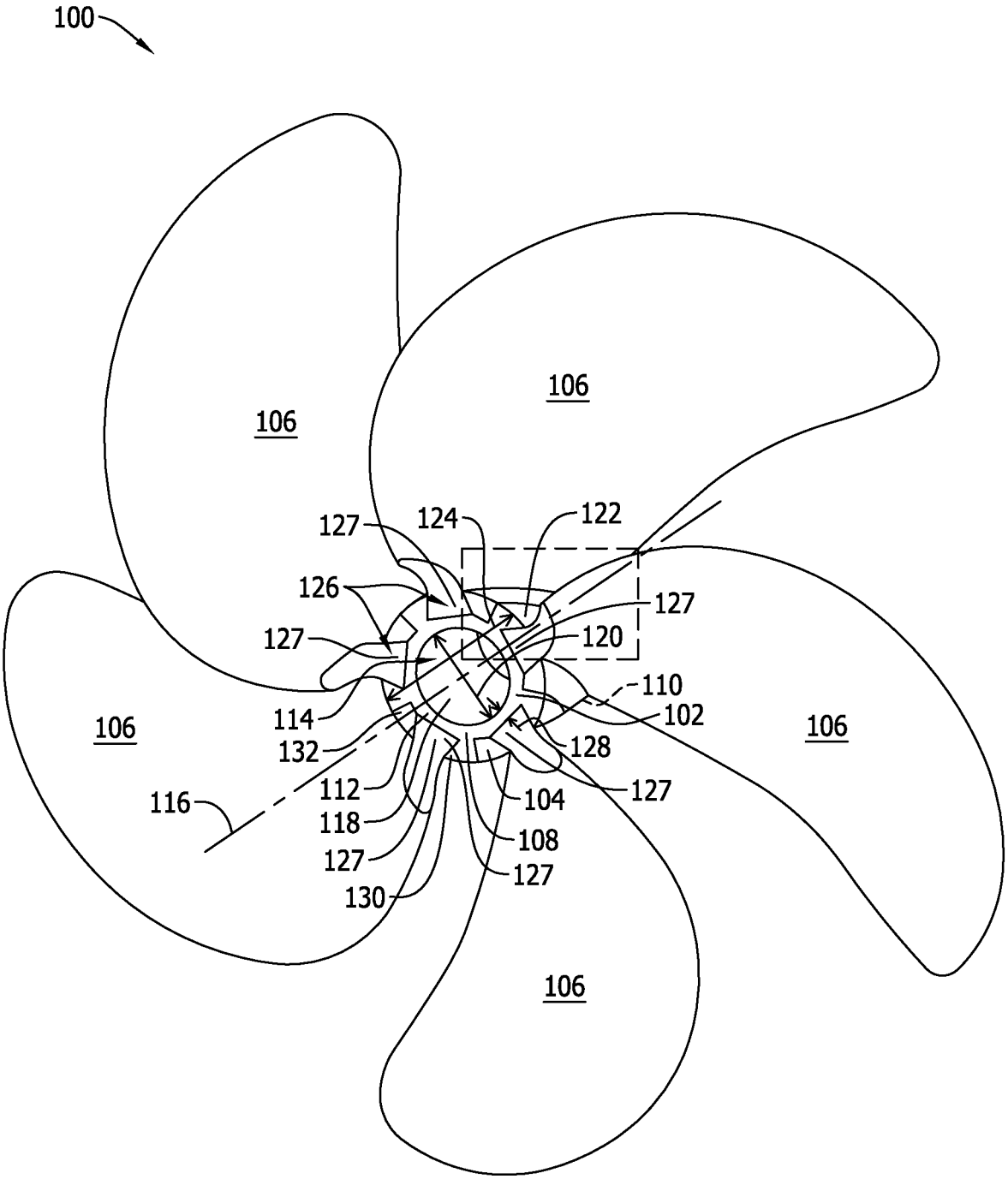
FIG. 1 is a perspective view of a marine propeller assembly in accordance with an example embodiment of the present disclosure.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

As used herein, the terms "axial" and "axially" refer to directions and orientations that extend substantially parallel to a centerline of the marine propeller assembly. Moreover, the terms "radial" and "radially" refer to directions and orientations that extend substantially perpendicular to the centerline of the marine propeller assembly. In addition, as used herein, the terms "circumferential" and "circumferentially" refer to directions and orientations that extend arcuately about the centerline of the marine propeller assembly.

Embodiments of the marine propeller described herein provide a cost-effective method for reducing three dimensional peak stresses in a transition region of the marine propeller. The marine propeller includes a thin propeller body coupled to a thick dovetail. The propeller body has a highly cambered shape to promote propulsion through the water. A transition region transitions the shape of the thin propeller body into the thick dovetail. The dovetail is coupled to a hub and attaches the propeller body to the hub. Rotational forces are transferred from the hub to the propeller body through the dovetail and the transition region. Three dimensional peak stresses occur at the transition region as the marine propeller rotates through the water. These three dimensional peak stresses are amplified when the blade dovetail is either skewed relative to the engine centerline or curved. The marine propeller also includes at least one transition relief to reduce the three dimensional peak stresses. The transition relief includes a geometric relief in at least one of a forward end of the blade body and an aft end of the blade body, a root of the blade body, and the dovetail. The transition relief reduces the twist loads and three dimensional peak stresses in the blade body, dovetail, and the transition region.

FIG. 1 is a perspective view of a marine propeller assembly 100 in accordance with an example embodiment of the present disclosure. In the example embodiment, marine propeller assembly 100 includes a hub 102, a plurality of wedges 104, and a plurality of separable blades 106.

Hub 102 includes a first face 108, a second face 110 (not shown in FIG. 1, facing away from the view in FIG. 1), and a hub body 112 extending between first face 108 and second face 110. In the example embodiment, first face 108 is spaced axially forward of second face 110. Hub body 112 includes a central bore 114 that is axisymmetric with an axis of rotation 116 of marine propeller assembly 100. Bore 114 includes a radially inner bore surface 118 having an internal diameter (ID) 120. Hub 102 includes a radially outer hub surface 122 having an outer diameter (OD) 124. In one embodiment, outer hub surface 122 includes a plurality of dovetail grooves 126 that extend radially inwardly from outer hub surface 122 a predetermined depth 128. Each of the plurality of dovetail grooves 126 extend generally axially along hub body 112 from first face 108 to second face 110. Each of the plurality of dovetail grooves 126 includes a first undercut sidewall 130 and a second sidewall 132 spaced apart circumferentially. Each of the plurality of dovetail grooves 126 is configured to receive a respective wedge 104 of the plurality of wedges 104 and a dovetail 127 of respective blade 106 of the plurality of separable blades 106.

Figure 2:
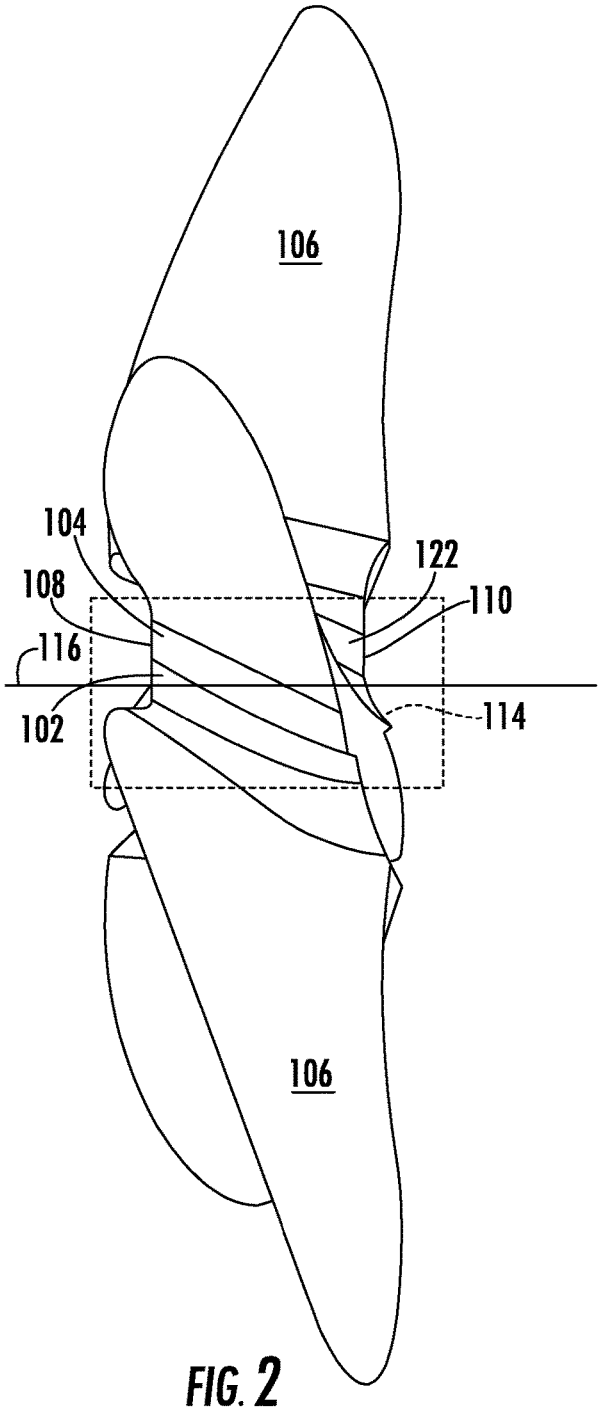
FIG. 2 is a side view of the marine propeller assembly shown in FIG. 1.
Figure 2A:
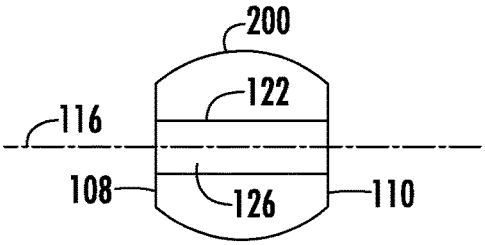
FIG. 2A is a detail view of a hub of FIG. 2 illustrating a dovetail groove in an axial configuration.
Figure 2B:
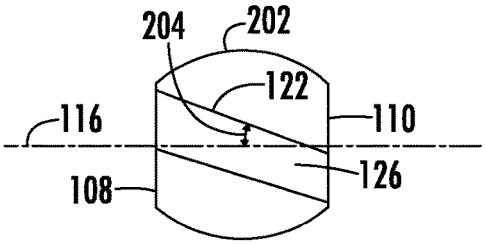
FIG. 2B is a detail view of a hub of FIG. 2 illustrating a dovetail groove in a skewed configuration.
Figure 2C:
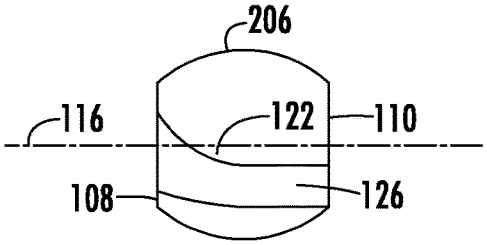
FIG. 2C is a detail view of a hub of FIG. 2 illustrating a dovetail groove in a curved configuration.

FIG. 2 is a side view of marine propeller assembly 100. FIG. 2A is an example embodiment of a detail 200 of hub 102 illustrating dovetail groove 126 that extends straight axially (or axial configuration) between first face 108 and second face 110 parallel to axis of rotation 116. FIG. 2B is a detail 202 illustrating dovetail groove 126 that extends linearly at a skew angle 204 (or skewed configuration) between first face 108 and second face 110. FIG. 2C is a detail 206 illustrating dovetail groove 126 that extends arcuately (or curved configuration) between first face 108 and second face 110.

Figure 3:
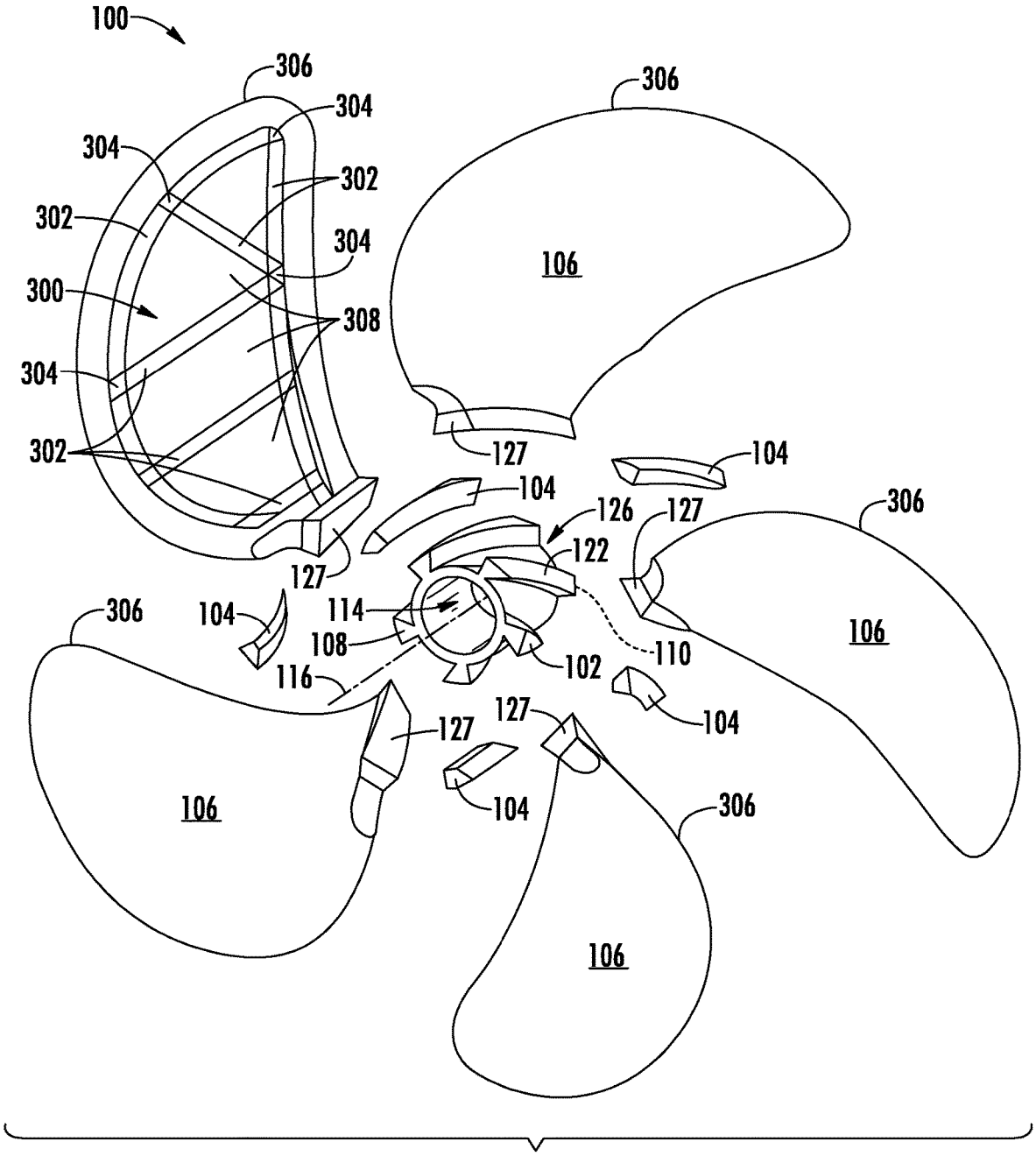
FIG. 3 is an exploded view of the marine propeller assembly shown in FIG. 1.

FIG. 3 is an exploded view of marine propeller assembly 100 in accordance with an example embodiment of the present disclosure. In the example embodiment, hub 102 is illustrated with plurality of dovetail grooves 126 extending arcuately between first face 108 and second face 110. A blade 106 is illustrated cutaway showing an interior structure 300 that may be used in one embodiment. Interior structure 300 includes a plurality of frame members 302 coupled together at respective frame joints 304. In various embodiments, dovetail 127 is formed of a metallic material or a composite material and coupled to a respective composite blade portion 306 of a respective blade 106 of plurality of blades 106. In various embodiments, each blade 106 may be formed using interior structure 300, which may be at least partially surrounded by a filler material, such as, but not limited to, a foamed material 308. In another embodiment, each blade 106 may be formed of a filler material.

Figure 4:
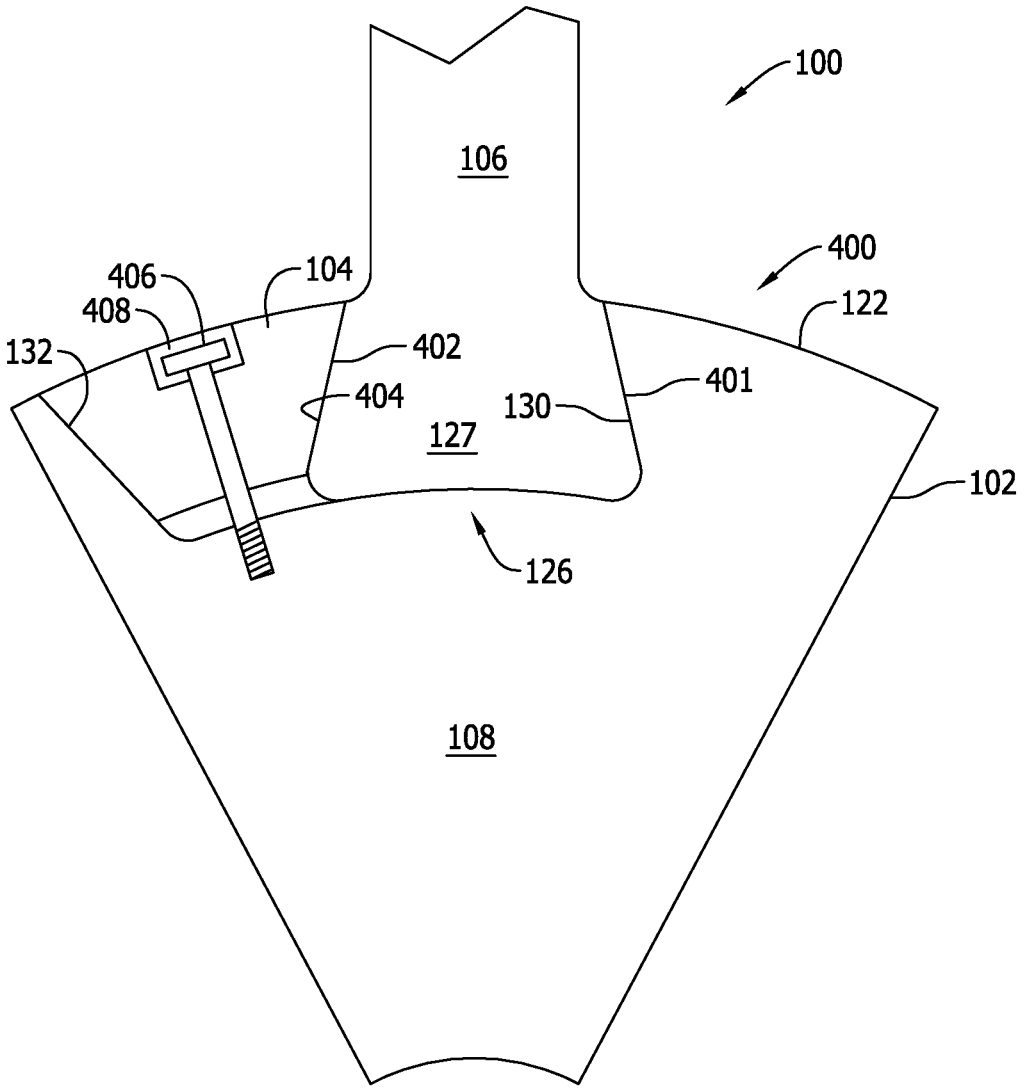
FIG. 4 is an axial view, looking forward of a circumferential segment of the marine propeller assembly shown in FIG. 1.

FIG. 4 is an axial view, looking forward of a circumferential segment 400 of marine propeller assembly 100 (shown in FIG. 1). In the example embodiment, dovetail 127 is retained in dovetail groove 126 by undercut sidewall 130 engaging a complementary first dovetail sidewall 401 and by a first wedge sidewall 402 engaging a complementary second dovetail sidewall 404. Wedge 104 is retained in dovetail groove 126 by one or more fasteners, such as, but not limited to, one or more threaded fasteners 406, for example, one or more bolts. In the example embodiment, a head 408 of fastener 406 is countersunk into a radially outer surface of wedge 104.

Figure 5:
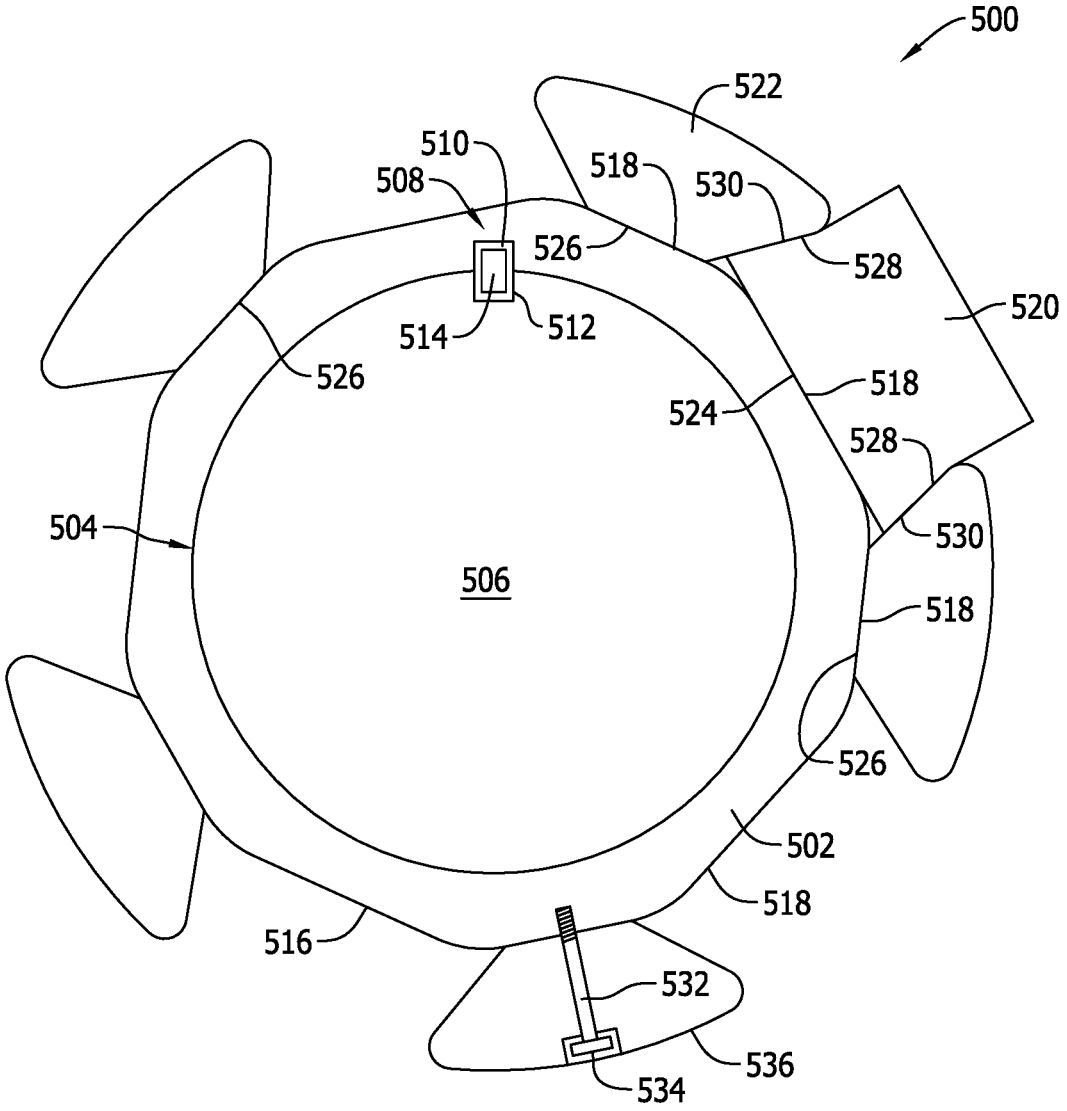
FIG. 5 is an axial view of another embodiment of a marine propeller assembly.

FIG. 5 is an axial view of another embodiment of a marine propeller assembly 500. In the example embodiment, a hub 502 includes a central bore 504 configured to receive a propulsion shaft 506 therethrough. In some embodiments, hub 502 is keyed onto propulsion shaft 506 using, for example, but not limited to, a keyed joint 508 including a keyway 510, a keyseat 512, and a key 514. Keyed joint 508 is used to connect hub 502 to propulsion shaft 506. Keyed joint 508 prevents relative rotation between connect hub 502 to propulsion shaft 506 and facilitates torque transmission between hub 502 and propulsion shaft 506. In one embodiment, an outer radial surface 516 of hub 502 includes a plurality of circumferentially-spaced flats 518. Each flat is configured to receive a blade dovetail 520 or a wedge 522. Specifically, flats 518 are generally planar surfaces that are complementary to a planar radially inner surface 524 of dovetail 520 and a radially inner surface 526 of wedge 522. In various embodiments, flats 518 and surfaces 524 and 526 have contoured surfaces that are complementary with respect to each other. For example, flats may include a generally concave contour while surfaces 524 and 526 include a generally convex contour and vice versa. Other contours may be used and each contour may be a simple contour or may be a complex contour. Blade dovetail 520 is retained against hub by wedges 522 positioned on either circumferential side of blade dovetail 520. Sidewall 528 of wedges 522 are undercut to provide an interference fit with complementary sidewalls 530 of blade dovetail 520. Wedges 522 are retained against hub 502 using for example, fasteners 532, such as, but not limited to threaded fasteners, for example, bolts. In one embodiment, a head 534 of fastener 532 is countersunk into a radially outer surface 536 of wedge 522.

Figure 6:
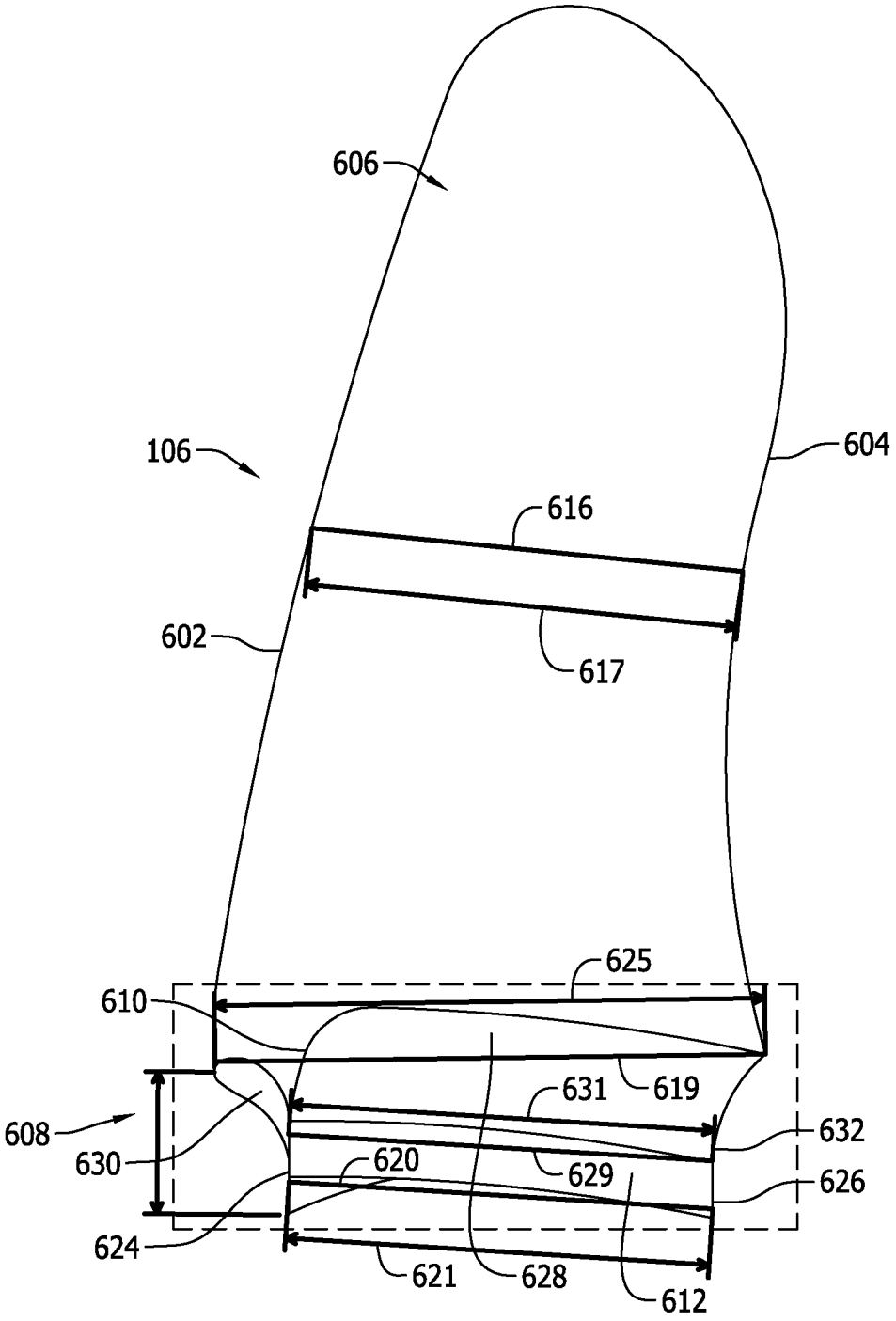
FIG. 6 is a perspective view of the propeller blade shown in FIG. 1.
Figure 7:
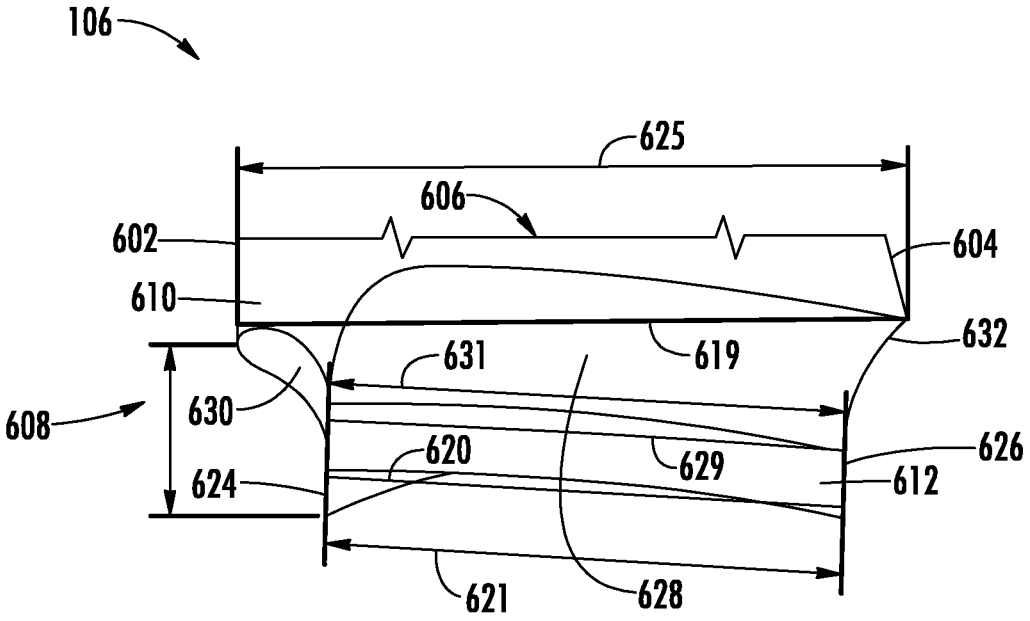
FIG. 7 is a partial view the propeller blade shown in FIG. 6.
Figure 8:
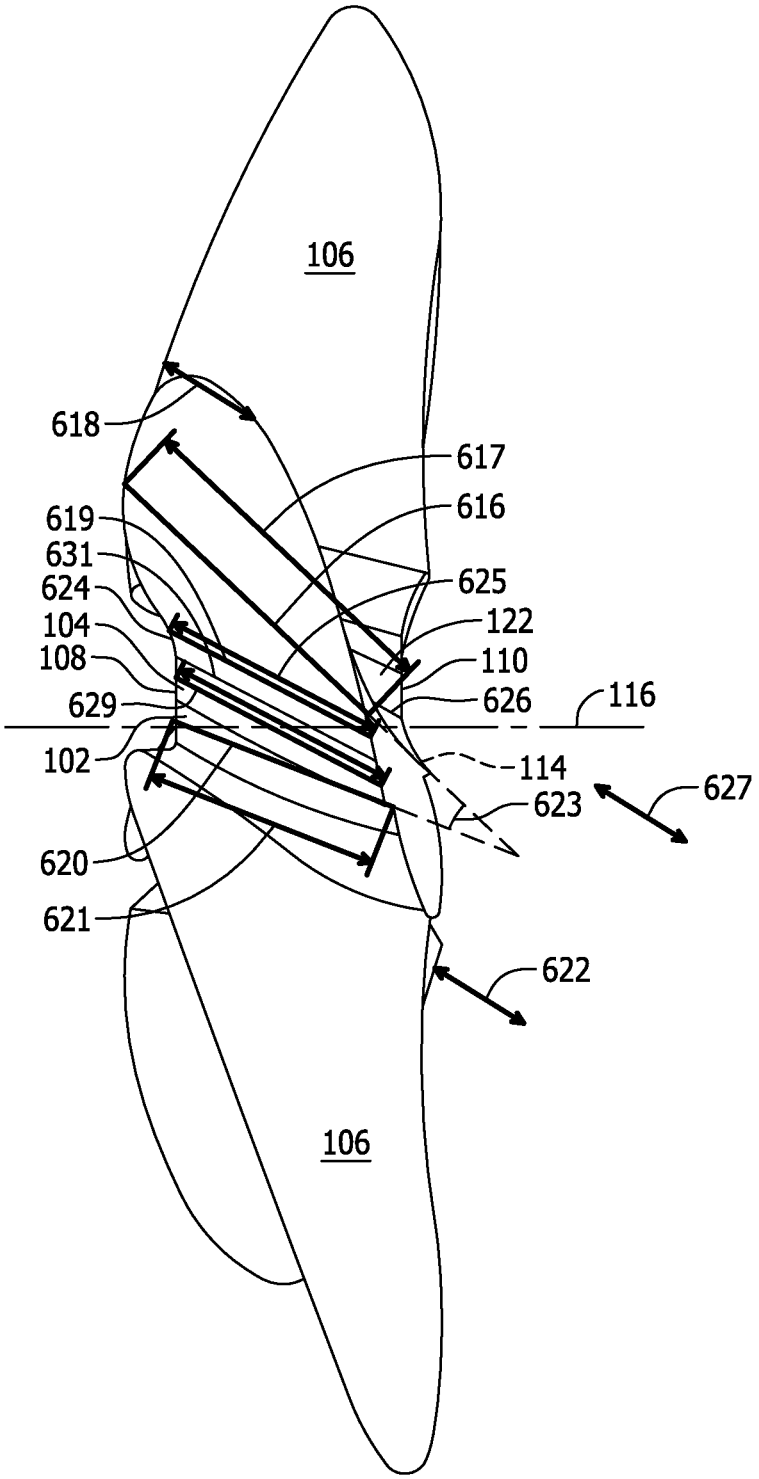
FIG. 8 is a side view of the marine propeller assembly shown in FIGS. 6 and 7.

FIG. 6 is a perspective view of an embodiment of blade 106. FIG. 7 is a sectional view of the embodiment of blade 106 shown in FIG. 6. FIG. 8 is a perspective view of the embodiment of blade 106 shown in FIGS. 6 and 7. In the exemplary embodiment, blade 106 includes a leading edge 602, a trailing edge 604, and a blade body 606 extending therebetween. Blade body 606 includes a highly cambered or asymmetrical shape to promote propulsion through the water. Blade 106 also includes a blade root 608 formed at a radially inner base 610 of blade body 606. Blade root 608 includes a dovetail 612 and a transition region 628. Dovetail 612 is formed at a radially inner side of blade root 608. Transition region 628 is formed at a transition from blade body 606 to dovetail 612. Blade body 606 includes a blade body chord line 616, having a blade body chord length 617, oriented in a first direction 618. Dovetail 612 includes a dovetail chord line 620, having a dovetail chord length 621, oriented in a second direction 622 and extending between an axially forward face 624 of dovetail 612 and an axially aft face 626 of dovetail 612. An angle 623 is formed between blade body chord line 616 and dovetail chord line 620. The interface between transition region 628 and blade body 606 forms a blade body transition chord line 619, having a blade body transition chord length 625, oriented in a third direction 627.

A transition region 628 transitions the shape of blade body 606 into the shape of dovetail 612. Angle 623 provides a measure of the degree of transition within transition region 628. The greater the value of angle 623, the greater the transition within transition region 628 and the greater the three dimensional peak stresses within transition region 628. The three dimensional peak stresses within transition region 628 may exceed a threshold value, which may cause damage to blade 106. Transition region 628 includes a transition region chord line 629, having a transition region chord length 631.

Dovetail 612 and transition region 628 include a forward transition relief 630 and an aft transition relief 632. In the exemplary embodiment, blade 106 includes both forward and aft transition reliefs 630 and 632. In other embodiments, blade 106 may include only forward transition relief 630 or only aft transition relief 632. Forward and aft transition reliefs 630 and 632 reduce dovetail chord length 621 and transition region chord length 631 relative to blade body transition chord length 625. In the exemplary embodiment, dovetail chord length 621 is less than or equal to about 95% of blade body transition chord length 625. In another embodiment, transition region chord length 631 is less than or equal to about 95% of blade body transition chord length 625. In yet another embodiment, dovetail chord length 621 and transition region chord length 631 is less than or equal to about 95% of blade body transition chord length 625.

During operation, hub 102 rotates blade 106 through water. Rotational forces are transferred from hub 102 to blade body 606 through dovetail 612 and transition region 628. Three dimensional peak stresses occur within transition region 628 as blade 106 rotates through the water. These three dimensional peak stresses are amplified when dovetail 612 includes a skewed or curved configuration as shown in detail 202 or 206. Forward and aft transition reliefs 630 and 632 reduce twisting load and three dimensional peak stresses within transition region 628 and dovetail 612 below the threshold value which may cause damage to blade 106. Forward and aft transition reliefs 630 and 632 effectively results in a thicker blade section remaining at the leading edge and trailing edge transition regions 602 and 604.

The above-described geometric reliefs provide an efficient method for reducing three dimensional peak stresses in marine propellers. Specifically, the above-described marine propeller includes at least one transition relief that reduces the twist loads and three dimensional peak stresses in a transition region of a marine propeller.

An exemplary technical effect of the methods, systems, and apparatus described herein includes at least one of: (a) reducing the chord length of a marine propeller in a transition region, (b) reducing the twist loads in a transition region of a marine propeller, and (c) reducing three dimensional peak stresses in a transition region of a marine propeller.

Exemplary embodiments of the marine propeller are described above in detail. The marine propellers, and methods of operating such propellers and component devices are not limited to the specific embodiments described herein, but rather, components of the systems and/or steps of the methods may be utilized independently and separately from other components and/or steps described herein. For example, the methods and systems may also be used in combination with other systems requiring a marine propeller, and are not limited to practice with only the systems and methods as described herein. Rather, the exemplary embodiment can be implemented and utilized in connection with many other machinery applications that are currently configured to receive and accept marine propellers.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blade member for a propeller defining an axial direction parallel to a centerline of the propeller and a radial direction perpendicular to the centerline, the blade member comprising:

a leading edge, a trailing edge, and a blade body extending therebetween, said blade body comprising a blade body chord line extending in a first direction;

a blade root formed at a radially inner base of said blade body, said blade root includes a dovetail and a transition region;

said dovetail formed at a radially inner side of said blade root, said dovetail comprising a dovetail chord line extending in a second direction, different than the first direction, between an axially forward face of said dovetail and an axially aft face of said dovetail, said dovetail chord line having a dovetail chord length;

said transition region formed between said blade body and said dovetail, said transition region comprising a transition region chord line having a transition region chord length, said blade body and said transition region forming a blade body transition chord line extending in a third direction, different than the first and second directions, at the interface of said blade body and said transition region, said blade body transition chord line having a blade body transition chord length; and a transition relief comprising a geometric relief in at least one of a forward end and an aft end of said transition region, wherein the transition relief is arranged between the transition region chord line and the blade body transition chord line such that the transition relief alters the direction of the dovetail chord line to the direction of the blade body transition chord line radially within a portion of the transition region bounded by the transition relief, and wherein said transition relief is sized such that said a peak stress of said transition region is reduced to less than said a predetermined threshold, and wherein said dovetail chord length is less than said blade body transition chord length.

2. The blade member of claim 1, wherein said dovetail comprises an axial configuration.

3. The blade member of claim 1, wherein said dovetail comprises a skewed configuration.

4. The blade member of claim 1, wherein said dovetail comprises a curved configuration.

5. The blade member of claim 1, wherein said transition relief is sized such that said dovetail chord length is reduced by greater than or equal to five percent of said blade body transition chord length.

6. A blade member for a propeller defining an axial direction parallel to a centerline of the propeller and a radial direction perpendicular to the centerline, the blade member comprising:

a leading edge, a trailing edge, and a blade body extending therebetween, said blade body comprising a blade body chord line extending in a first direction;

a blade root formed at a radially inner base of said blade body, said blade root includes a dovetail and a transition region;

said dovetail formed at a radially inner base of said blade body, said dovetail comprising a dovetail chord line extending in a second direction, different than the first direction, between an axially forward face of said dovetail and an axially aft face of said dovetail;

said transition region formed between said blade body and said dovetail, said transition region comprising a transition region chord line, said transition region causing a peak stress in the blade member greater than a predetermined threshold, said blade body and said transition region forming a blade body transition chord line extending in a third direction, different than the first and second directions, at the interface of said blade body and said transition region; and a transition relief comprising a geometric relief in at least one of a forward end and an aft end of said transition region, wherein the transition relief is arranged between the transition region chord line and the blade body transition chord line such that the transition relief alters the direction of the dovetail chord line to the direction of the blade body transition chord line radially within a portion of the transition region bounded by the transition relief, and wherein said transition relief is sized such that said peak stress is reduced to less than said predetermined threshold.

7. The blade member of claim 6, wherein said dovetail comprises an axial configuration.

8. The blade member of claim 6, wherein said dovetail comprises a skewed configuration.

9. The blade member of claim 6, wherein said dovetail comprises a curved configuration.

10. A propeller assembly defining an axial direction parallel to a centerline of the propeller assembly and a radial direction perpendicular to the centerline, comprising:

a central hub comprising:

a leading end, a trailing end, and a hub body extending therebetween; and a plurality of channels spaced circumferentially around said central hub and extending between said forward end and said aft end;

a plurality of blade wedges configured to be inserted into said plurality of channels; and a plurality of blades, each blade of said plurality of blades comprising:

a leading edge, a trailing edge, and a blade body extending therebetween, said blade body comprising a blade body chord line extending in a first direction;

a blade root formed at a radially inner base of said blade body, said blade root includes a dovetail and a transition region;

said dovetail formed at a radially inner side of said blade root, said dovetail comprising a dovetail chord line extending in a second direction, different than the first direction, between an axially forward face of said dovetail and an axially aft face of said dovetail, said dovetail chord line having a dovetail chord length, wherein the blade body chord line and the dovetail chord line define a non-zero angle therebetween within a plane defined along the axial and radial directions;

said transition region formed between said blade body and said dovetail, said transition region comprising a transition region chord line having a transition region chord length, said blade body and said transition region forming a blade body transition chord line extending in a third direction, different than the first and second directions, at the interface of said blade body and said transition region, said blade body transition chord line having a blade body transition chord length; and a transition relief comprising a geometric relief in at least one of a forward end and an aft end of said transition region, wherein the transition relief is arranged between the transition region chord line and the blade body transition chord line such that the transition relief alters the direction of the dovetail chord line to the direction of the blade body transition chord line radially within a portion of the transition region bounded by the transition relief, and wherein said dovetail chord length is less than said blade body transition chord length.

11. The propeller assembly of claim 10, wherein said dovetail comprises an axial configuration.

12. The propeller assembly of claim 10, wherein said dovetail comprises a skewed configuration.

13. The propeller assembly of claim 10, wherein said dovetail comprises a curved configuration.

* * * * *